US007217892B2

(12) United States Patent
Hecht

(10) Patent No.: US 7,217,892 B2
(45) Date of Patent: May 15, 2007

(54) MULTIFUNCTION KEY ASSEMBLY

(75) Inventor: Gil Hecht, 30/18 Ahad Ha'am Street, 22443 Nahariya (IL)

(73) Assignees: Iscar Ltd., Tefen (IL); Gil Hecht, Nahariya (IL)

( * ) Notice: Subject to any disclaimer, the term of this patent is extended or adjusted under 35 U.S.C. 154(b) by 38 days.

(21) Appl. No.: 11/212,745

(22) Filed: Aug. 29, 2005

(65) Prior Publication Data

US 2007/0045088 A1 Mar. 1, 2007

(51) Int. Cl.
*H01H 9/54* (2006.01)

(52) U.S. Cl. ..... 200/1 R; 200/5 R; 200/17 R

(58) Field of Classification Search ..... 200/1 R, 200/4, 5 A, 5 R, 6 A, 329, 17 R
See application file for complete search history.

(56) References Cited

U.S. PATENT DOCUMENTS 6,162,999 A * 12/2000 Ishikawa et al. ..... 200/6 A
6,344,618 B1 * 2/2002 Sato ..... 200/6 A
6,441,753 B1 8/2002 Montgomery
6,635,832 B1 * 10/2003 Oster et al. ..... 200/6 A
6,765,165 B1 * 7/2004 Torrens ..... 200/512
6,897,391 B2 * 5/2005 Gavalda ..... 200/512
2002/0104743 A1 8/2002 Niiyama

FOREIGN PATENT DOCUMENTS

JP 10269902 10/1998

OTHER PUBLICATIONS

International Search Report, PCT/IL2006/000970, dated Dec. 13, 2006.

* cited by examiner

*Primary Examiner*—Richard K. Lee
(74) *Attorney, Agent, or Firm*—Womble Carlyle

(57) ABSTRACT

A multifunction key assembly for inputting data to an electronic device. The multifunction key assembly has two major switches operated by a single key cap and at least four minor switches. The key cap can be displaced vertically into three major active positions and horizontally into four minor active positions, giving rise to twelve distinct output data signals for inputting to the electronic device.

14 Claims, 9 Drawing Sheets

MULTIFUNCTION KEY ASSEMBLY

FIELD OF THE INVENTION

The present invention relates to a multifunction key assembly for an electronic device.

BACKGROUND OF THE INVENTION

There is considerable demand for the miniaturization of electronic devices in general and for cellular telephones in particular. On the other hand, there is increasing demand for electronic devices that include more and more features. Invariably, these demands result in a reduction in the display area, that is, the size of the display screen, or of the viewable area. A major reason for this being the necessity of maintaining a conventional keypad matrix arrangement for inputting data. Although the size and the spacing of the buttons that form a conventional keypad matrix arrangement are constantly being reduced as a result of miniaturization, there is a limit to their reduction. Moreover, with small buttons, or closely spaced buttons, there is a high likelihood of accidentally depressing an unintended button which is adjacent an intended button, or even simultaneously depressing two adjacent buttons thereby providing false input data. Moreover, since the buttons are depressed one by one for each input data, speed of operation is limited.

U.S. Pat. No. 6,441,753 discloses a multifunction key assembly for electronic devices. The multifunction key assembly has a button member having an upper contoured surface defining nine key regions, which in a preferred embodiment, are arranged in a manner consistent with the one through nine keys of a conventional telephone keypad with the central key region representing the five key of a telephone keypad and each perimeter key region represents the remaining keys. However, unlike the conventional keypad matrix the zero, asterisk and pound sign keys are missing. An auxiliary button may be representative of the zero key. Alternatively, each key region may serve multiple functions. For example, the five key region may operate as a conventional zero key upon a double-click. This option is suggested, but its implementation is not described. Whatever the case, the numeral zero cannot be entered through the principal mode of operation and therefore every time a zero that has to be entered will disrupt the smooth flow of data input.

It is an object of the present invention to provide an improved multifunction key assembly for inputting data to an electronic device and an improved method for inputting data to an electronic device.

This object is attained with the subject matter in accordance with the respective claims.

SUMMARY OF THE INVENTION

In accordance with the present invention there is preferably provided a multifunction key assembly comprising:

two major switches, a first-major switch, a second-major switch, and four first-minor switches, all of the switches being electrically connected to each other, a single key cap mechanically coupled to the two major switches, the single key cap being capable of selectively activating any one of the four first-minor switches and of selectively activating the two major switches either separately or simultaneously, together with any one of the first-minor switches, whereby, a total of twelve possible distinct output signals can be outputted from the multifunction key assembly, four distinct output signals being obtained when the first-major switch is activated together with any one of the four first-minor switches, four further distinct output signals being obtained when the second-major switch is activated together with any one of the four first-minor switches, and four yet further distinct output signals being obtained when the first and second-major switches are simultaneously activated together with any one of the four first-minor switches.

The multifunction key assembly may be located external to, located in, or partially located in, an electronic device and the output signals may be used as input data to the electronic device. Generally, the output signals will be electric signals, which may be transformed into other types of signals.

In accordance with a preferred embodiment, the key cap is activated by moving it from a major non-active position to a major active position, the key cap being moveable from the major non-active position to the major active position by vertically depressing at least a portion of the key cap, wherein in the major non-active position both major switches are in an electrically off-state and wherein in a major active position at least one of the major switches is in an electrically on-state, there being a total of three major active positions, a first-major active position corresponding to one of the major switches being in an electrically on-state, a second-major active position corresponding to the other one of the major switches being in an electrically on-state and a third major active position corresponding to the two major switches being simultaneously in an electrically on-state.

It will be appreciated that depressing at least a portion of the key cap defines a direction, which direction is referred to herein as the vertical direction.

Further in accordance with a preferred embodiment, the key cap is horizontally displaceable in two mutually perpendicular directions to any one of four minor active positions.

Typically, the two mutually perpendicular directions are termed North-South and East-West and the four minor active positions are, in clockwise direction, North, East, South and West. The two mutually perpendicular directions are coplanar and perpendicular to the vertical direction in which the at least a portion of the key cap is depressed.

Yet further in accordance with a preferred embodiment, for each combination of a given minor active position and a particular major active position of the key cap, a specific distinct output signal of the twelve possible distinct output signals is outputted by the multifunction key assembly.

Still yet further in accordance with a preferred embodiment, each major switch comprises a major base and a major stem extending therefrom and wherein the keycap is coupled to the major stem of each major switch.

In accordance with a first preferred embodiment, the key cap has a centrally located rod extending from a lower surface thereof and passing between the four first-minor switches, and a given minor active position of the four minor active positions is obtained by the rod urging the minor stem of a given first-minor switch of the four first-minor switches towards its minor base until its electrical state is changed from an off-state to an on-state, thereby activating the given first-minor switch.

In accordance with another preferred embodiment, the multifunction key assembly further comprises a first guide member having two throughgoing guide grooves perpendicular to each other forming a cross-shaped aperture, through which the rod passes, the first guide member being located between the key cap and the four first-minor switches.

In accordance with a second preferred embodiment, the multifunction key assembly further comprises four second-minor switches electrically connected to each other and to all the other switches, wherein the major stem of the first-major switch passes between the four first-minor switches and the major stem of the second-major switch passes between the four second-minor switches, wherein a given minor active position of the four minor active positions is obtained by the major stem of the first-major switch urging the minor stem of a given first-minor switch of the four first-minor switches towards its minor base until its electrical state is changed from an off-state to an on-state, thereby activating the given first-minor switch, and by the stem of the second-major switch urging the minor stem of a given second-minor switch of the four second-minor switches towards its minor base until its electrical state is changed from an off-state to an on-state, thereby activating the given second-minor switch.

In accordance with yet another preferred embodiment, the multifunction key assembly further comprises exactly two guide members, each guide member having two throughgoing guide grooves perpendicular to each other forming a cross-shaped aperture, wherein the major stem of the first-major switch passes through the cross shaped aperture of a first of the guide members and the major stem of the second-major switch passes through the cross shaped aperture of a second of the guide members, the first guide member being located between the key cap and the four first-minor switches, and the second guide member being located between the key cap and the four second-minor switches.

Preferably, there are exactly two major switches that are electrically connected to each other.

There is also provided in accordance with the present invention a method for providing one of twelve distinct output signals, preferably comprising the steps of:

(a) providing a multifunction key assembly comprising exactly two major switches and exactly four first-minor switches electrically connected to the two major switches and to each other and a single key cap mechanically coupled to the two major switches;

(b) vertically displacing the key cap from a major non-active position to a major active position by depressing at least a portion of the key cap, wherein in the major non-active position both major switches are in an electrically off-state and wherein in an active position at least one of the major switches is in an electrically on-state; and (c) horizontally displacing the key cap from a minor non-active position to a minor active position by displacing the key cap in one of two mutually perpendicular directions to one of four minor active positions, wherein in the minor non-active position all four first-minor switches are in an electrically off-state and wherein in a minor active position one of the first-minor switches is in an electrically on-state, thereby providing the one of the twelve distinct output signals.

The order of carrying out the steps of the method does not have to be in accordance with the order given above. For example, if desired, step (c) can be carried out before step (b).

In accordance with a preferred embodiment, the method comprises the further step of:

(d) providing exactly four second-minor switches electrically connected to the two major switches and to the four first-minor switches, wherein in a minor active position one of the second-minor switches is in an electrically on-state.

There is further provided in accordance with the present invention a cellular telephone comprising:

a casing having a plurality of surfaces;

a display screen; and a multifunction key assembly comprising:

two major switches and four first-minor switches electrically connected to the two major switches and to each other;

a single key cap mechanically coupled to the two major switches, the single key cap being capable of selectively activating each one of the four first-minor switches and of selectively activating the two major switches either separately or simultaneously, together with any one of the first-minor switches, whereby a total of twelve possible distinct output signals can be outputted from the multifunction key assembly.

If desired, the display screen is located on a front surface of the casing and the key cap is located on a side surface of the casing.

The present invention potentially provides the following advantages over conventional technologies:

1. It facilitates the miniaturization of electronic devices in general and cellular telephones in particular;
2. It enables the use of larger display screens;
3. The multifunction key is operated by a single key cap. The single key cap may be operated by the thumb of one hand of an operator. The single key cap is simple to operate. Twelve distinct output signals can be obtained by displacing the key cap horizontally in two mutually perpendicular directions (North-South, East-West) in combination with depressing the key cap at three different regions thereof.

Other advantages of the present invention are readily apparent to those skilled in the art from the following figures, description, and claims.

BRIEF DESCRIPTION OF THE DRAWINGS

For a better understanding of the present invention and to show how the same may be carried out in practice, reference will now be made to the accompanying drawings, in which.

DETAILED DESCRIPTION OF THE INVENTION

Figure 1:
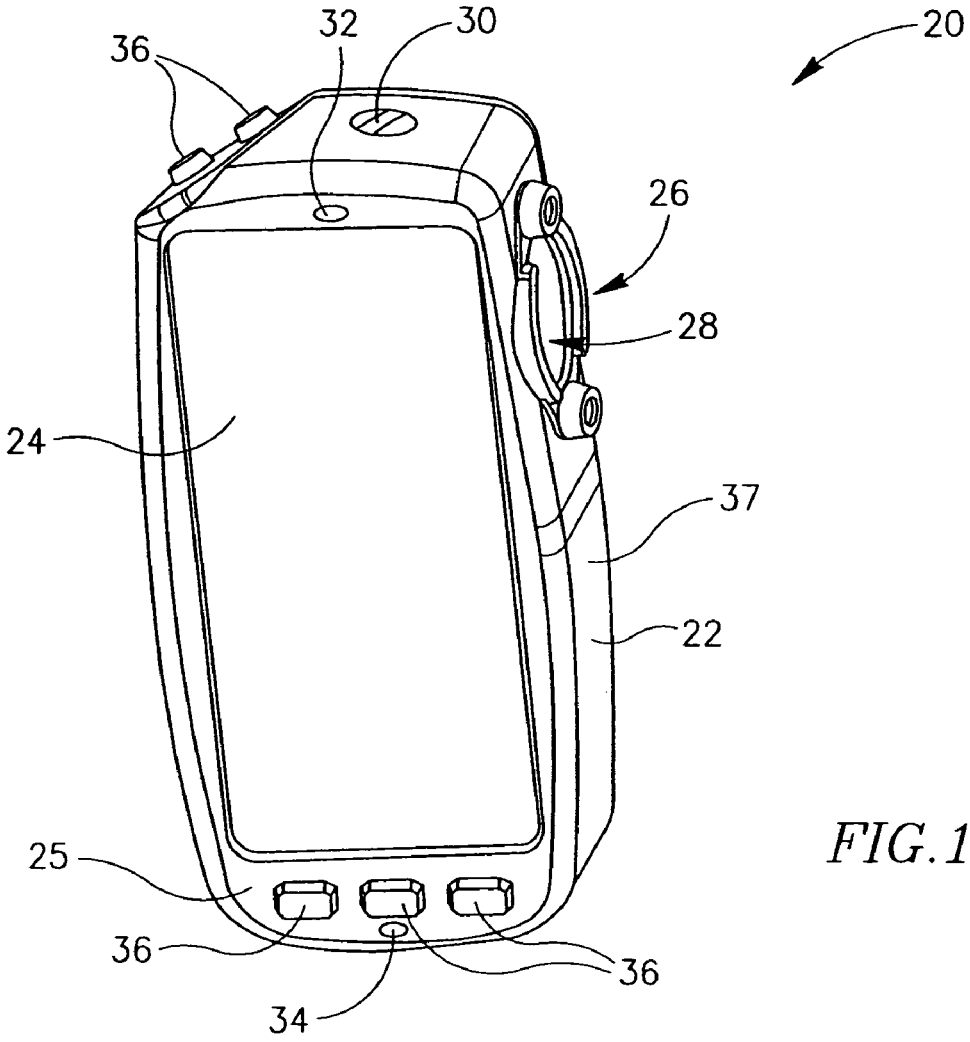
FIG. 1 is a perspective view of a typical cellular telephone with a multifunction key assembly according to the present invention.

Attention is drawn to FIG. 1 showing a typical electronic device 20 in accordance with the present invention. A non-binding example of such an electronic device 20 as illustrated in FIG. 1 is a cellular telephone. The electronic device 20 comprises a casing 22, a display screen 24 on a front surface 25 of the casing 22, a multifunction key assembly 26 in accordance with the present invention having a key cap 28, a loudspeaker 30, an earphone 32, a microphone 34 and auxiliary keys 36. Noticeably missing is the conventional keypad for inputting data to the electronic device 20. Moreover, the multifunction key assembly 26 of the present invention is much smaller than the conventional keypad and therefore may be positioned within the electronic device 20 in such a manner that the key cap 28 is located on a side surface 37 of the casing 22 of the electronic device 20, thereby freeing the great majority of space of the front surface 25 for the display screen 24, as shown in FIG. 1.

Figure 2:
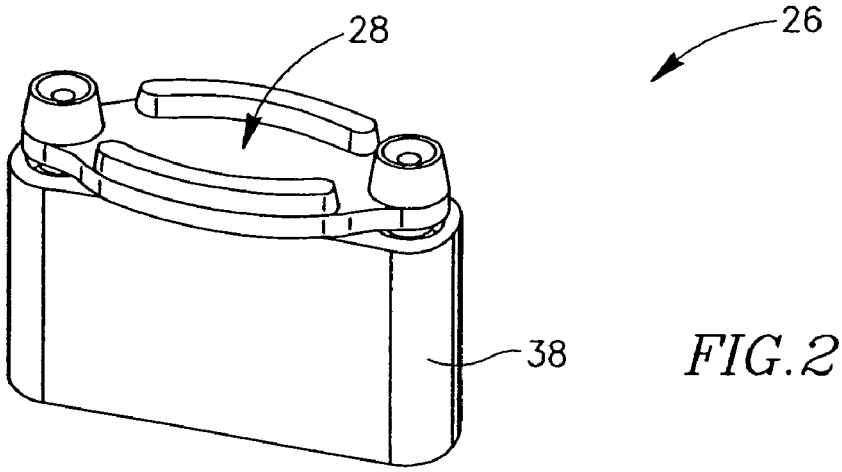
FIG. 2 is a top perspective view of a multifunction key assembly module according to the present invention.

The multifunction key assembly 26 can be incorporated in the electronic device 20 as an integral part thereof, or it may be manufactured as a separate module and conveniently inserted and removed therefrom as required. The multifunction key assembly 26 in the form of a module is shown in FIG. 2. For convenience of illustration only, the multifunction key assembly 26 in the form of a module will be described. This has no limiting effect on the description of the multifunction key assembly 26, but merely serves to restrict the description to the members of the multifunction key assembly 26, thereby excluding from the description members of the electronic device 20 which are not relevant to the invention. The multifunction key assembly 26 in the form of a module has a housing 38, within which all the members of the multifunction key assembly 26 are located, apart from the key cap 28. It will be appreciated that if the multifunction key assembly 26 is not a separate module but is incorporated in the electronic device 20 as an integral part thereof, then the housing 38 of the multifunction key assembly 26 may be a part of the casing 22 of the electronic device 20.

Figure 3:
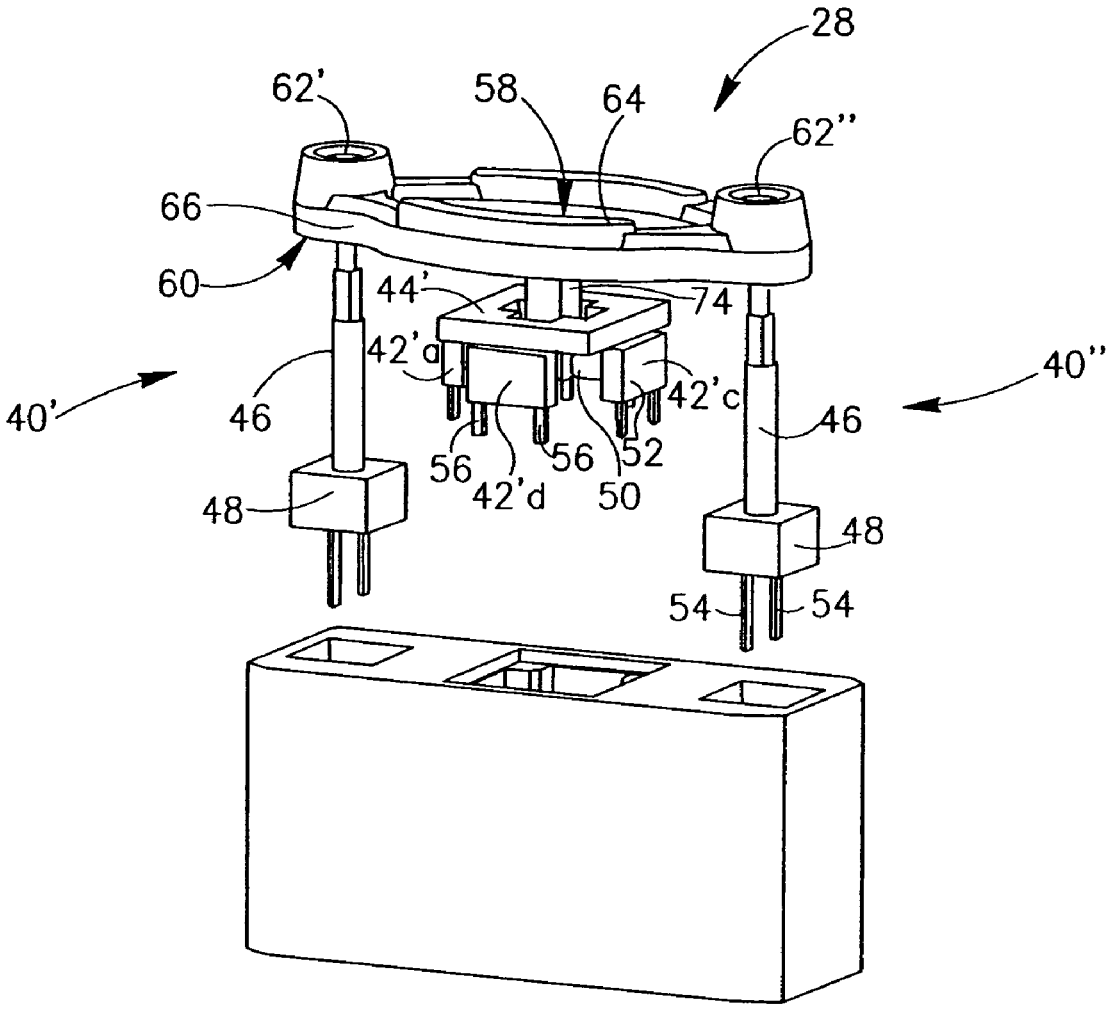
FIG. 3 is a partially exploded top perspective view of the multifunction key assembly module of FIG. 2, in accordance with a first embodiment of the present invention.
Figure 4:
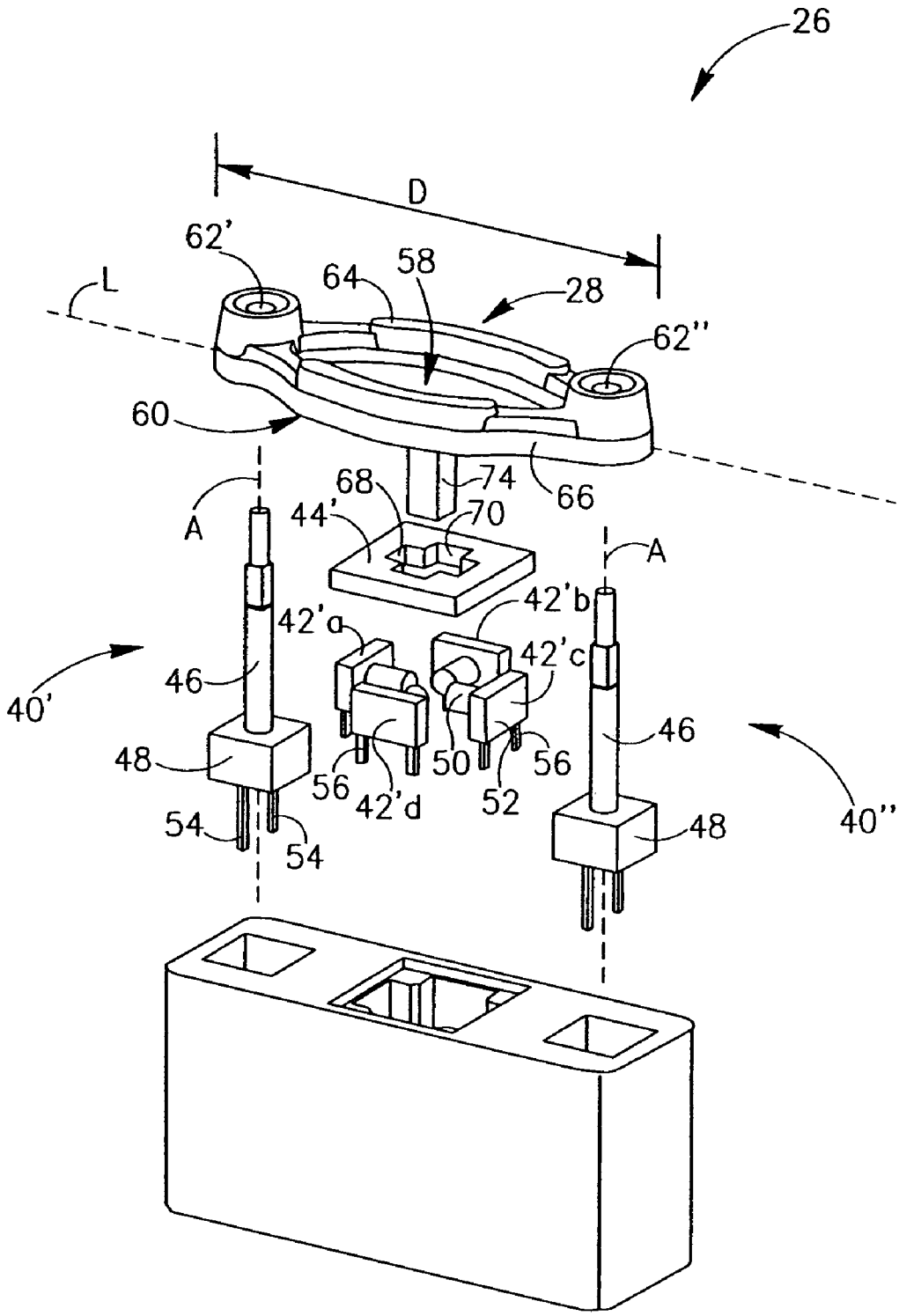
FIG. 4 is a fully exploded view of the multifunction key assembly module of FIG. 3.

With reference to FIGS. 3 and 4, the multifunction key assembly 26 in accordance with a first embodiment of the present invention, comprises two major switches 40, which will be referred to individually as first and second-major switches 40', 40", four first-minor switches 42', which will be referred to individually as first, second, third and fourth first-minor switches 42'*a*, 42'*b*, 42'*c*, 42'*d* and a first guide member 44'. Both the major and first-minor switches 40, 42' are electrical switches and may be push button switches. Each major switch 40 has a major stem 46 extending from a major base 48 and each first-minor switch 42' has a minor stem 50 extending from a minor base 52. The major stem 46 of each major switch 40 has a longitudinal axis A, defining a longitudinal direction of the major switch 40. Extending from the major base 48 of each major switch 40 are two electrically conducting major leads 54. Similarly, extending from the minor base 52 of each first-minor switch 40 are two electrically conducting minor leads 56.

The key cap 28 has opposing upper and lower surfaces 58, 60 and has a generally elongated oval or elliptical shape having a long dimension D defining a longitudinal axis L of the key cap 28. Two push knobs 62 (62', 62") project from the upper surface 58 of the key cap 28 at ends of the key cap 28, that is, at extremities of the long dimension D of the key cap 28. In addition, two opposing elongated projections 64 project from the upper surface 58, extending adjacent long edges 66 of the key cap 28 on opposite sides of the longitudinal axis L. The end of each major stem 46 distal the major base 48 is retained in a corresponding bore (not seen) in the lower surface 60 of the key cap 28, thereby mechanically connecting the key cap 28 to the major switches 40.

The first guide member 44' has two throughgoing guide grooves 68, 70 perpendicular to each other forming a cross-shaped aperture 72. One of the guide grooves 68 is aligned with the longitudinal axis L of the key cap 28 and will be referred to herein as the longitudinal guide groove. The other guide groove 70 is perpendicular to the longitudinal axis L of the key cap 28 and will be referred to herein as the transverse guide groove. The key cap 28 has a centrally located rod 74 extending from its lower surface 60 in a direction generally parallel to the major stems 46 and generally perpendicular to the minor stems 50. The first guide member 44' is located between the first-minor switches 42' and the key cap 28, with the rod 74 of the key cap 28 passing through the cross-shaped aperture 72 of the first guide member 44' and between all four of the first-minor switches 42'.

Figure 5:
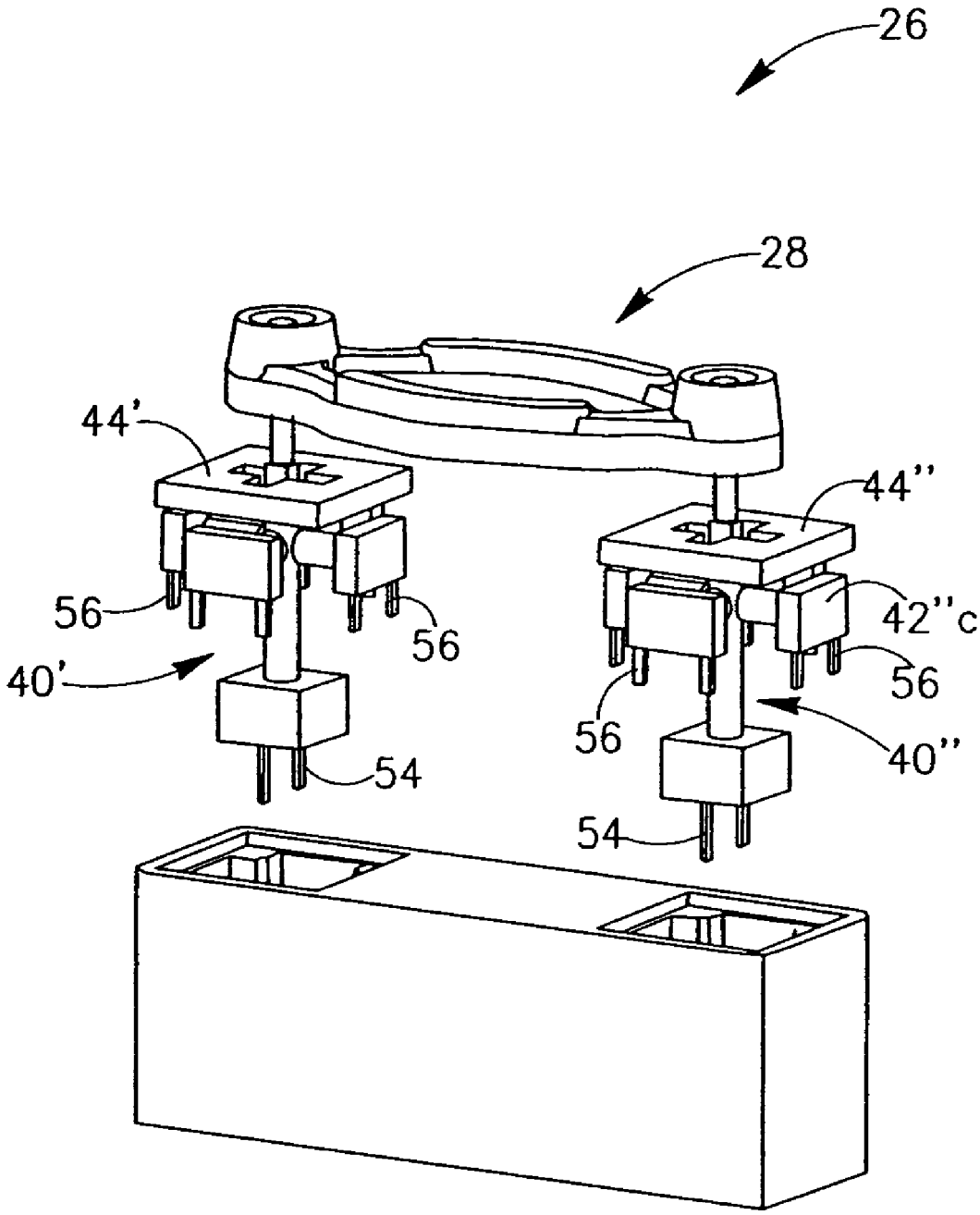
FIG. 5 is a partially exploded top perspective view of the multifunction key assembly module of FIG. 2, in accordance with a second embodiment of the present invention.
Figure 6:
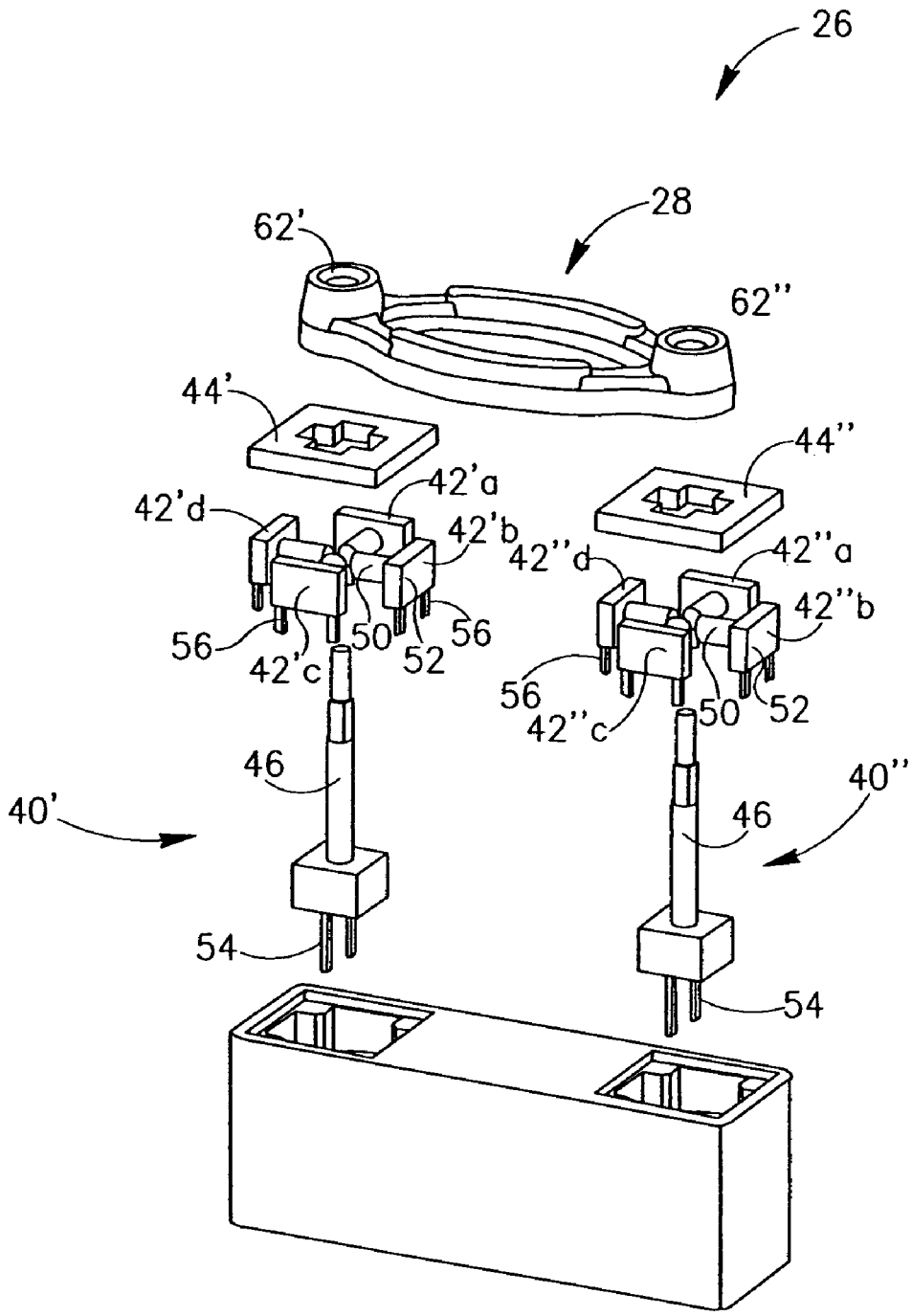
FIG. 6 is a fully exploded view of the multifunction key assembly module of FIG. 5.
Figure 7:
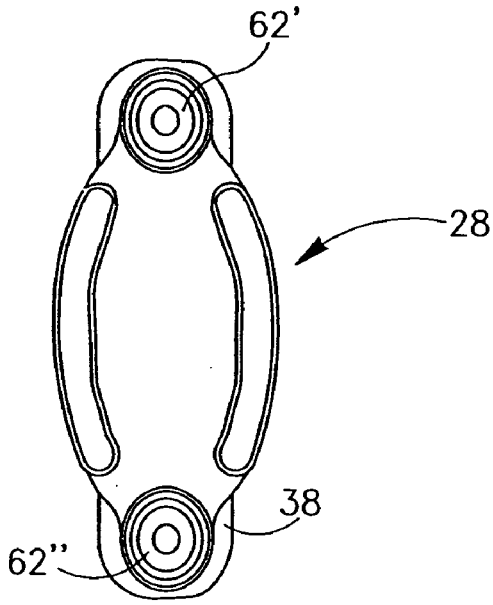
FIG. 7 is a top view of the multifunction key assembly module of FIG. 2 with key cap in a major non-active position.

Attention is now drawn to FIGS. 5 and 6. The multifunction key assembly 26 in accordance with the second embodiment of the present invention, comprises two major switches 40 (40', 40"), four first-minor switches 42' (42'*a*, 42'*b*, 42'*c*, 42'*d*), four similar or identical second-minor switches 42" (42"a, 42"b, 42"c, 42"d) and first and second guide members 44', 44". Unlike the first embodiment, in accordance with the second embodiment the key cap 28 is not provided with a rod. The first guide member 44' is located between the first-minor switches 42' and the key cap 28, with the major stem 46 of the first-major switch 40' passing between all four of the first-minor switches 42' and through the cross-shaped aperture 72 of the first guide member 44'. Similarly, the second guide member 44" is located between the second-minor switches 42" and the key cap 28, with the major stem 46 of the second-major switch 40" passing between all four of the second-minor switches 42" and through the cross-shaped aperture 72 of the second guide member 44". As with the first embodiment, the end of each major stem 46 distal the major base 48 is retained in a corresponding bore (not seen) in the lower surface 60 of the key cap 28, thereby mechanically connecting the key cap 28 to the major switches 40', 40".

The key cap 28 can be moved in various directions by applying an external force to it. In general, an external force is applied to the key cap 28 by an operator placing a thumb on the upper surface 60 of the key cap 28, or on one of the push knobs 62', 62" and then either depressing the key cap 28 and displacing it "vertically" by applying a force to the key cap 28 in the longitudinal direction of the major switches 40', 40", or displacing the key cap 28 "horizontally" by applying a force to the key cap 28 in a direction perpendicular to the longitudinal direction of the major switches 40', 40". In addition, both vertical and horizontal forces can be applied simultaneously. The major stems 46 are preferably resilient to allow sufficient horizontal displacement of the key cap 28.

Figure 8:
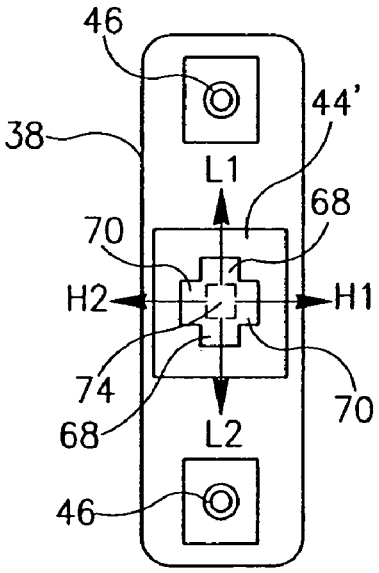
FIG. 8 is a top view of the multifunction key assembly module of FIG. 2, in accordance with the first embodiment, with key cap removed, showing where the major stem of the key cap would be located (dashed line) if the key cap was not removed.
Figure 9:
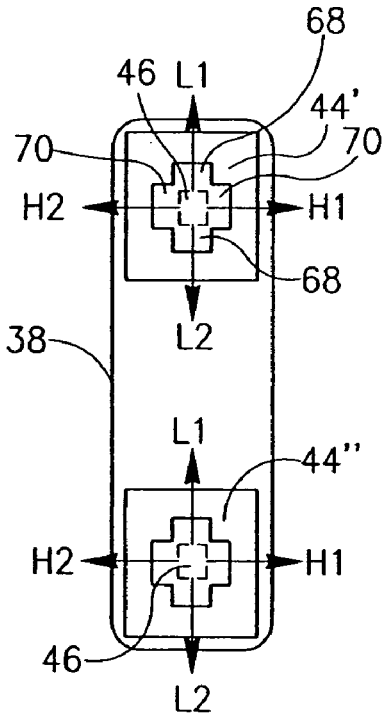
FIG. 9 is a top view of the multifunction key assembly module of FIG. 2, in accordance with the second embodiment, with key cap removed.
Figure 10A:
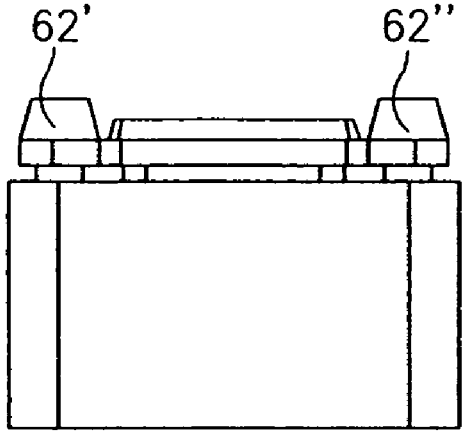
FIG. 10A is a side view of the multifunction key assembly module of FIG. 2 with key cap in a major non-active position.

Attention is now referred additionally to FIGS. 7 to 9 and FIGS. 10A to 10D. If no vertical force is applied to the key cap 28, then the key cap 28 is said to be in a non-major active state (FIG. 10A). If no external force at all is applied to the key cap 28, then the key cap 28 is un-displaced horizontally (FIGS. 7 to 9) and un-displaced vertically (FIG. 10A) and is said to be in its rest position. Since the rod 74 is affixed to the key cap 28 and therefore with the key cap 28 removed the rod 74 is not in the housing, it is shown by a dashed line in FIG. 8, representing where the rod 74 would be positioned if the key cap 28 was not removed. In the first embodiment, the rod 74 is constrained to move horizontally in the guide grooves 68, 70 (FIG. 8), and in the second embodiment, the major stems 46 are constrained to move horizontally in the guide grooves 68, 70 (FIG. 9). Therefore, horizontal displacement of the key cap 28 is constrained to longitudinal and transverse movement, corresponding to movement of the rod 74 (first embodiment) or the major stems 46 (second embodiment) in the longitudinal and transverse guide grooves 68, 70, in the longitudinal and transverse directions L1, L2 and H1, H2 respectively. In other words, the key cap 28 can be displaced horizontally in two mutually perpendicular directions to four horizontal displacement directions L1, L2, H1, H2.

When the key cap 28 is displaced vertically by depressing it, it is displaced from its rest position, or from a major non-active position, (FIG. 10A), to a "major active position". There are precisely three major active positions. A first-major active position (FIG. 10B) is obtained by displacing a first end of the key cap 28 vertically, that is, by depressing the first of the push knobs 62' so that only the major stem 46 of the first-major switch 40' is displaced vertically as it is urged towards its major base 48 thereby changing the electrical state of the of the first-major switch 40' from an off-state (electrically non-conducting) to an on-state (electrically conducting). A second-major active position (FIG. 10C) is obtained by displacing a second end of the key cap 28 vertically, that is, by depressing the second push knob 62" so that only the major stem 46 of the second-major switch 40" is displaced vertically as it is urged towards its major base 48 thereby changing the electrical state of the second-major switch 40" from an off-state to an on-state. A third major active position (FIG. 10D) is obtained by displacing the whole of the key cap 28 vertically, that is, by depressing the upper surface 60 of the key cap 28 at a location between the two push knobs 62', 62" so that both major stems 46 are displaced vertically thereby changing the electrical state of both major switches 40', 40" from an off-state to an on-state. In other words, a "major active position" of the key cap 28 is defined as an on-state of at least one of the major switches 40', 40".

After the key cap 28 has been moved to a given major active position by depressing it vertically, an output signal can be obtained by moving the key cap 28 to a particular "minor active position". A "minor active position" is defined herein as an on-state (electrically conducting) of at least one of the minor switches 42' (42'*a*, 42'*b*, 42'*c*, 42'*d*), 42" (42"a, 42"b, 42"c, 42"d). This is achieved by displacing the key cap 28 horizontally either longitudinally or transversely so that force is applied to the minor stem 50 of a particular minor switch 42', 42" urging it towards its minor base 52 until its electrical state is changed from an off-state (electrically non-conducting) to an on-state (electrically conducting). In the first embodiment, it is the rod 74 of the key cap 28 that applies force to the minor stem 50 of a particular first-minor switch 42'. In the second embodiment, it is the stem 46 of the first-major switch 40' that applies force to the minor stem 50 of a particular first-minor switch 42' and the stem 46 of the second-major switch 40" that applies force to the minor stem 50 of a particular second-minor switch 42".

A distinct output signal is obtained for each combination of a given major active position and a particular minor active position. The elongated projections 64 serve to prevent the operator's thumb from slipping when displacing the key cap 28 horizontally or when the operator's thumb is at a location between the two push knobs 62. Since there are three major active positions (FIG. 10B, FIG. 10C and FIG. 10D) and four minor active positions, corresponding to the four horizontal displacement directions L1, L2, H1, H2 of the key cap and the ensuing activation of a particular minor switch 42', 42", a total of twelve distinct output signals can be obtained. The four horizontal displacement directions L1, L2, H1, H2, of the key cap 28 and the ensuing activation of a particular minor switch 42', 42", define first, second, third and fourth minor active positions of the key cap 28.

As a non-binding example, one could choose these twelve distinct output signals to represent the 10 numerals 1, 2, 3, 4, 5, 6, 7, 8, 9, 0 and the functions "clear" and "back space". Which particular combinations of major active positions and minor active positions are used to represent these twelve outputs is a matter of choice. As a non-binding example, the four output signals for the numerals 1, 2, 3 and 4, defining a first set of outputs, may be obtained using the first-major active position (FIG. 10B) along with the first, second, third and fourth minor active positions, respectively; the four output signals for the numerals 5, 6, 7 and 8, defining a second set of outputs, may be obtained using the second-major active position (FIG. 10C) along with the first, second, third and fourth minor active positions, respectively; and the four output signals for the two numerals 9, 0, and the two functions "clear" and "back space", defining a third set of outputs, may be obtained using the third major active position (FIG. 10C) along with the first, second, third and fourth minor active positions, respectively.

Figure 11:
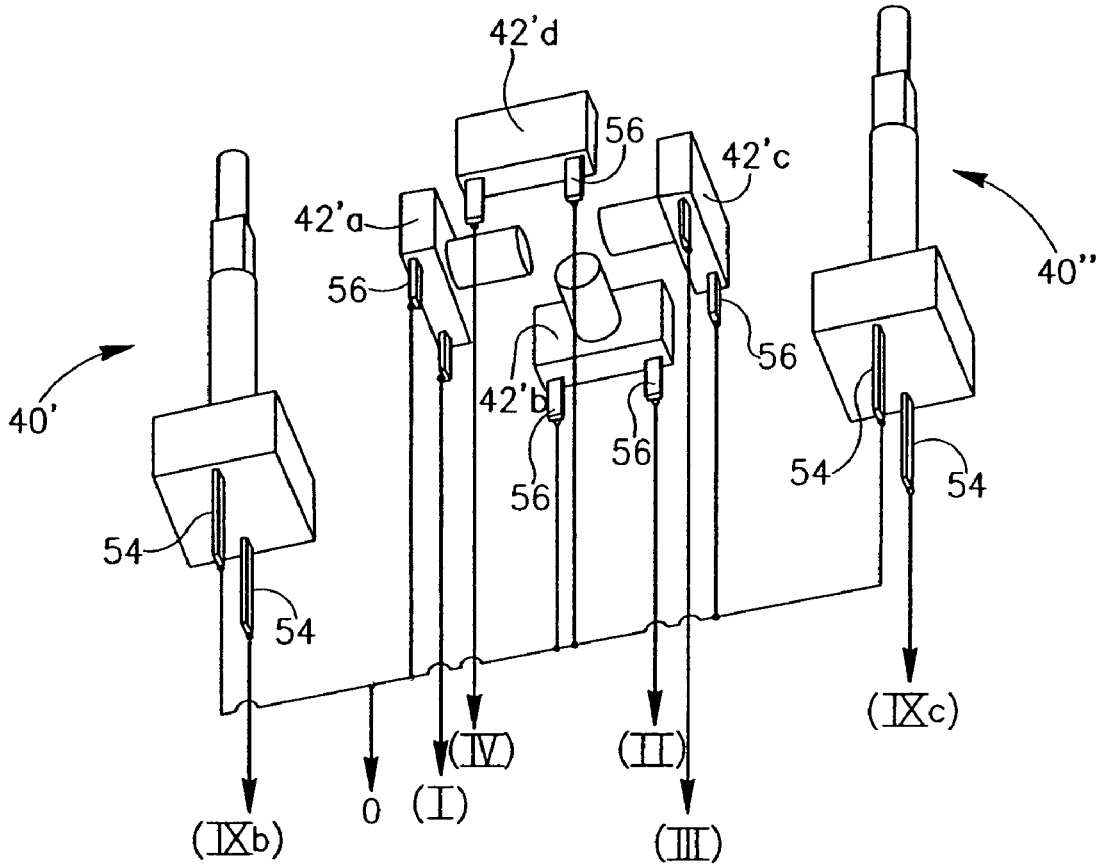
FIG. 11 is an illustrative view of one possible arrangement of the electrical wiring of the multifunction key assembly in accordance with the first embodiment.

Reference is now made to FIG. 11 showing an illustrative view of one possible arrangement for the electrical wiring of the multifunction key assembly 26 in accordance with the first embodiment that will enable the multifunction key assembly 26 to provide the output signals mentioned above. The two major switches 40', 40" and the four first-minor switches 42' (42'*a*, 42'*b*, 42'*c*, 42'*d*) are electrically connected to each other, with one of the electrically conducting major leads 54 of each major switch 40', 40" and one of the electrically conducting minor leads 56 of each first-minor switch 40' being electrically common, and the other electrically conducting major lead 54 of each major switch 40', 40" and the other electrically conducting minor lead 56 of each first-minor switch 40' being electrically common and grounded.

Figure 10B:
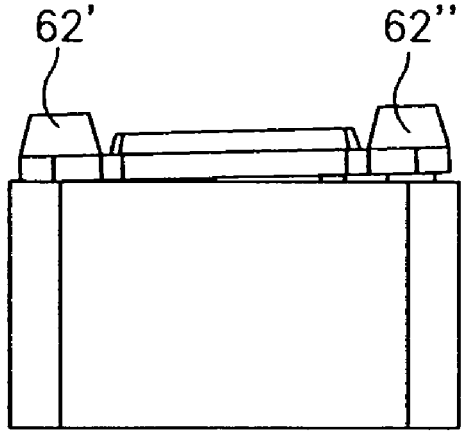
FIG. 10B is a side view of the multifunction key assembly module of FIG. 2 with key cap in a first-major active position.
Figure 10C:
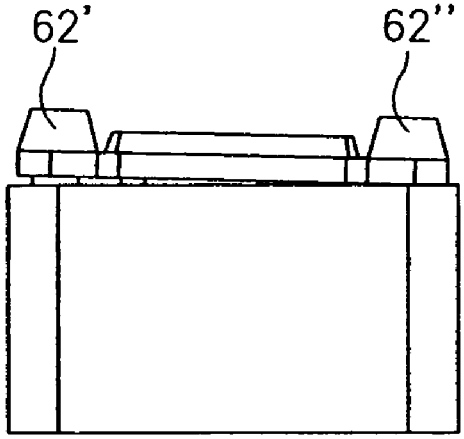
FIG. 10C is a side view of the multifunction key assembly module of FIG. 2 with key cap in a second-major active position.
Figure 10D:
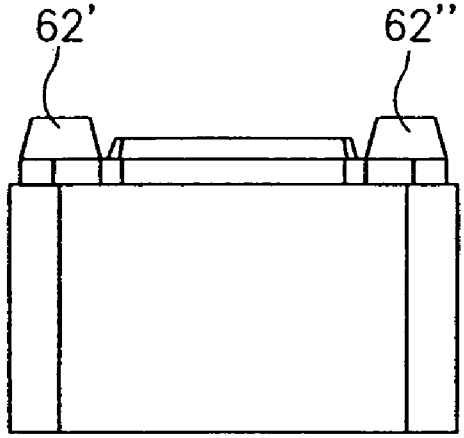
FIG. 10D is a side view of the multifunction key assembly module of FIG. 2 with key cap in a third-major active position.

For illustrative purposes, the output signals for the first, second, third and fourth minor active positions, are denoted by (I), (II), (III) and (IV), respectively, and the output signals for the first and second-major active positions are denoted by (IXb) and (IXc), respectively. With this notation, in accordance with the example given above, the output signal for the numeral 1, from the first set of outputs, is given symbolically by the combination (IXb)+(I), that is, the first push knob 62' is depressed, so that the first-major switch 40' is in an on-state, as shown in FIG. 10B and the key cap 28 is in the first-minor active position. Similarly, the output signal for the numeral 5, from the second set of outputs, is given symbolically by the combination (IXc)+(I), that is, the second push knob 62" is depressed, so that second-major switch 40" is in an on-state, as shown in FIG. 10C and the key cap 28 is in the first-minor active position. In order to obtain an output signal from the third set of output signals, both major switches 40', 40" have to be in an on-state, that is, both push knobs 62 have to be depressed, as shown in FIG. 10D. For example the output signal for the numeral 9 is given symbolically by the combination (IXb)+(IXc)+(I).

In order to output other signals, such as letters of the alphabet, the key cap 28 may be "double-clicked" before it is displaced in the manner described above. Alternatively, one or more of the auxiliary keys 36 may be actuated. Therefore, a large amount of information such as numerals, letters, symbols, functions, etc. can be outputted from the multifunction key assembly 26.

Figure 12:
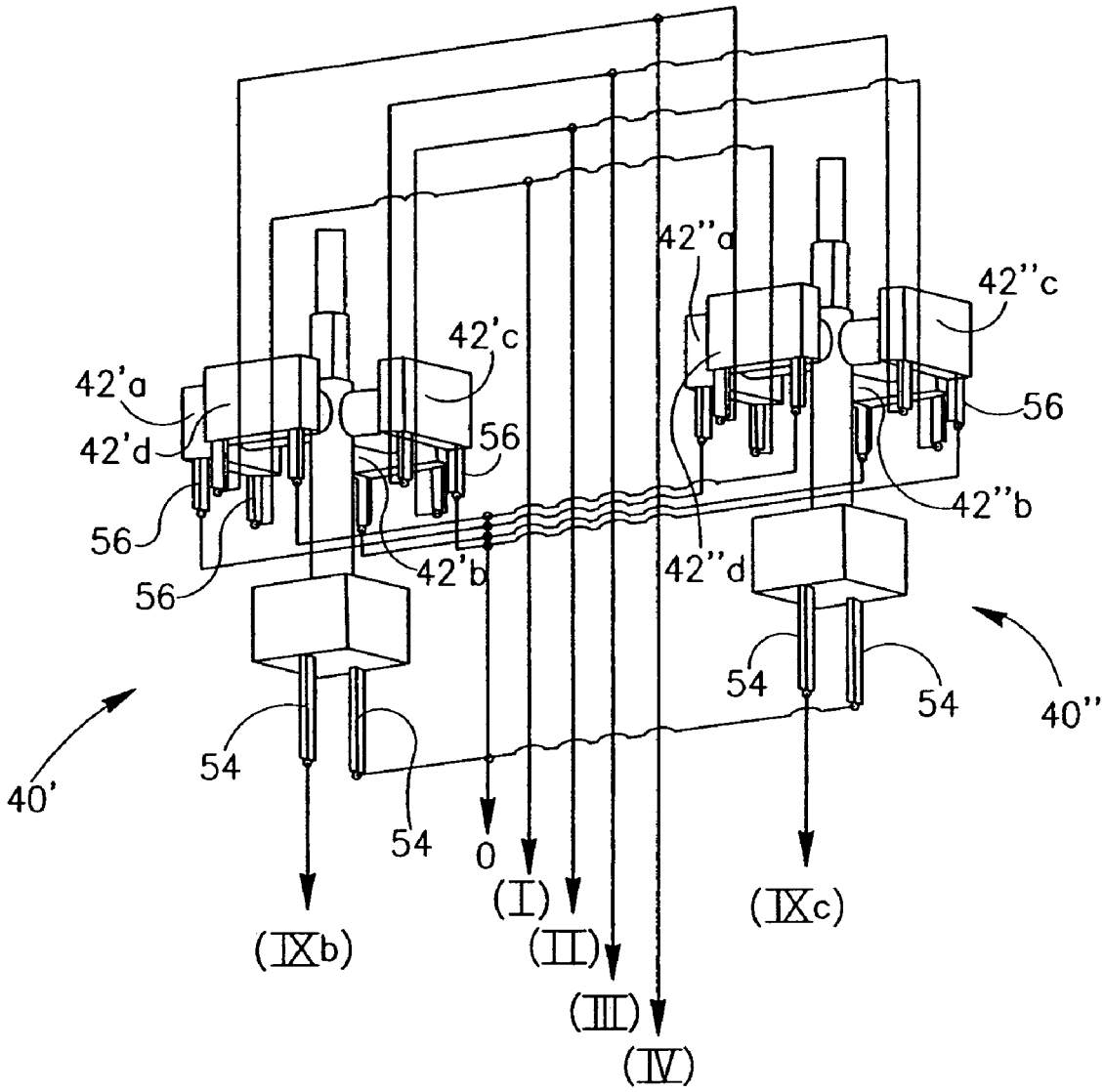
FIG. 12 is an illustrative view of one possible arrangement of the electrical wiring of the multifunction key assembly in accordance with the second embodiment.

Reference is now made to FIG. 12 showing an illustrative view of one possible arrangement for the electrical wiring of the multifunction key assembly 26 in accordance with the second embodiment that will enable the multifunction key assembly 26 to provide the same output signals as those obtained for the first embodiment. The two major switches 40', 40", the four first-minor switches 42' (42'*a*, 42'*b*, 42'*c*, 42'*d*) and the four second-minor switches 42" (42"*a*, 42"*b*, 42"*c*, 42"*d*) are electrically connected to each other, with one of the electrically conducting major leads 54 of each major switch 40', 40" and one of the electrically conducting minor leads 56 of each first-minor switch 42' and each second-minor switch 42" being electrically common, and the other electrically conducting major lead 54 of each major switch 40', 40" and the other electrically conducting minor lead 56 of each first-minor switch 40 and each second-minor switch 42" being electrically common and grounded.

The twelve distinct output signals are obtained from the multifunction key assembly 26 of the second embodiment, by applying the same set of operations to the key cap 28 as described for the first embodiment. For example, the output signal for the numeral 1, from the first set of outputs, is given symbolically by the combination (IXb)+(I), that is, the first push knob 62' is depressed, so that the first-major switch 40' is in an on-state, as shown in FIG. 10B and the key cap 28 is in the first-minor active position. As described above, the only difference between the first and second embodiments being that in the first embodiment, it is the rod 74 of the key cap 28 that applies force to the minor stem 50 of a particular first-minor switch 42' to obtain a particular minor active position of the key cap 28. Whereas, in the second embodiment, it is the stem 46 of the first-major switch 40' that applies force to the minor stem 50 of a particular first-minor switch 42' and the stem 46 of the second-major switch 40" that applies force to the minor stem 50 of a particular second-minor switch 42" to obtain a particular minor active position of the key cap 28.

Although the present invention has been described to a certain degree of particularity, it should be understood that various alterations and modifications could be made without departing from the scope of the invention as hereinafter claimed. In particular, the present invention has been described with reference to a cellular telephone. However, it will be appreciated that the present invention is also amenable to other like electronic devices.

The invention claimed is:

1. A multifunction key assembly comprising:

two major switches, a first-major switch, a second-major switch, and four first-minor switches, all of the switches being electrically connected to each other;

a single key cap mechanically coupled to the two major switches, the single key cap being capable of selectively activating any one of the four first-minor switches and of selectively activating the two major switches either separately or simultaneously, together with any one of the first-minor switches, whereby a total of twelve possible distinct output signals can be outputted from the multifunction key assembly, four distinct output signals being obtained when the first-major switch is activated together with any one of the four first-minor switches, four further distinct output signals being obtained when the second-major switch is activated together with any one of the four first-minor switches, and four yet further distinct output signals being obtained when the first and second-major switches are simultaneously activated together with any one of the four first-minor switches.

2. The multifunction key assembly according to claim 1, wherein the key cap is activated by moving it from a major non-active position to a major active position, the key cap being moveable from the major non-active position to the major active position by vertically depressing at least a portion of the key cap, wherein in the major non-active position both major switches are in an electrically off-state and wherein in a major active position at least one of the major switches is in an electrically on-state, there being a total of three major active positions, a first-major active position corresponding to one of the major switches being in an electrically on-state, a second-major active position corresponding to the other one of the major switches being in an electrically on-state and a third major active position corresponding to the two major switches being simultaneously in an electrically on-state.

3. The multifunction key assembly according to claim 2, wherein the key cap is horizontally displaceable in two mutually perpendicular directions to any one of four minor active positions.

4. The multifunction key assembly according to claim 3, wherein for each combination of a given minor active position and a particular major active position of the key cap, a specific distinct output signal of the twelve possible distinct output signals is outputted by the multifunction key assembly.

5. The multifunction key assembly according to claim 1, wherein:

each of the four first-minor switches comprises a minor base and a minor stem extending therefrom;

each major switch comprises a major base and a major stem extending therefrom; and the keycap is coupled to the major stem of each major switch.

6. The multifunction key assembly according to claim 5, wherein the key cap has a centrally located rod extending from a lower surface thereof and passing between the four first-minor switches, and a given minor active position of the four minor active positions is obtained by the rod urging the minor stem of a given first-minor switch of the four first-minor switches towards its minor base until its electrical state is changed from an off-state to an on-state, thereby activating the given first-minor switch.

7. The multifunction key assembly according to claim 6, further comprising a first guide member having two throughgoing guide grooves perpendicular to each other forming a cross-shaped aperture, through which the rod passes, the first guide member being located between the key cap and the four first-minor switches.

8. The multifunction key assembly according to claim 5, further comprising four second-minor switches electrically connected to each other and to all the other switches, wherein:

the major stem of the first-major switch passes between the four first-minor switches;

the major stem of the second-major switch passes between the four second-minor switches;

the key cap is horizontally displaceable in two mutually perpendicular directions to any one of four minor active positions; and a given minor active position of the four minor active positions is obtained by the major stem of the first-major switch urging the minor stem of a given first-minor switch of the four first-minor switches towards its minor base until its electrical state is changed from an off-state to an on-state, thereby activating the given first-minor switch, and by the major stem of the second-major switch urging the minor stem of a given second-minor switch of the four second-minor switches towards its minor base until its electrical state is changed from an off-state to an on-state, thereby activating the given second-minor switch.

9. The multifunction key assembly according to claim 8, further comprising exactly two guide members, each guide member having two throughgoing guide grooves perpendicular to each other forming a cross-shaped aperture, wherein the major stem of the first-major switch passes through the cross shaped aperture of a first of the guide members and the major stem of the second-major switch passes through the cross shaped aperture of a second of the guide members, the first guide member being located between the key cap and the four first-minor switches, and the second guide member being located between the key cap and the four second-minor switches.

10. The multifunction key assembly according to claim 1, wherein there are exactly two major switches that are electrically connected to each other.

11. A method for providing one of twelve distinct output signals comprising the steps of:

(a) providing a multifunction key assembly comprising exactly two major switches and exactly four first-minor switches electrically connected to the two major switches and to each other and a single key cap mechanically coupled to the two major switches;

(b) vertically displacing the key cap from a major non-active position to a major active position by depressing at least a portion of the key cap, wherein in the major non-active position both major switches are in an electrically off-state and wherein in an active position at least one of the major switches is in an electrically on-state; and (c) horizontally displacing the key cap from a minor non-active position to a minor active position by displacing the key cap in one of two mutually perpendicular directions to one of four minor active positions, wherein in the minor non-active position all four first-minor switches are in an electrically off-state and wherein in a minor active position one of the first-minor switches is in an electrically on-state, thereby providing the one of the twelve distinct output signals.

12. The method for providing one of twelve distinct output signals according to claim 11, comprising the further step of:

(d) providing exactly four second-minor switches electrically connected to the two major switches and to the four first-minor switches, wherein in a minor active position one of the second-minor switches is in an electrically on-state.

13. A cellular telephone comprising:

a casing having a plurality of surfaces;

a display screen; and a multifunction key assembly comprising:

two major switches and four first-minor switches electrically connected to the two major switches and to each other;

a single key cap mechanically coupled to the two major switches, the single key cap being capable of selectively activating each one of the four first-minor switches and of selectively activating the two major switches either separately or simultaneously, together with any one of the first-minor switches, whereby a total of twelve possible distinct output signals can be outputted from the multifunction key assembly.

14. A multifunction key assembly configured to selectively output any one of twelve distinct signals, comprising:

two major switches including a first major switch and a second major switch;

four first-minor switches; and a single key cap capable of selectively activating any one of the four first-minor switches, and simultaneously selectively activating either or both of the two major switches, whereby:

four distinct output signals are obtained when the first major switch is activated at the same time as any one of the four first-minor switches;

four further distinct output signals are obtained when the second major switch is activated at the same time as any one of the four first-minor switches; and four yet further distinct output signals are obtained when both major switches are simultaneously activated at the same time as any one of the four first-minor switches.

* * * * *